US005429364A

United States Patent [19]

Chang

[11] Patent Number: 5,429,364

[45] Date of Patent: Jul. 4, 1995

[54] COMBINATION OF CUP/PUZZLE

[76] Inventor: Kun-Sheng Chang, No. 25, Lane 59, Chung Cheng Rd., Lu Chou Hsiang, Taipei Hsien, Taiwan

[21] Appl. No.: 294,083

[22] Filed: Aug. 22, 1994

[51] Int. Cl.[6] ..... A63F 9/08

[52] U.S. Cl. ..... 273/153 S; 273/155

[58] Field of Search ..... 273/153 R, 155, 153 S

[56] References Cited

U.S. PATENT DOCUMENTS

| | | | |
|---|---|---|---|
| 2,931,657 | 4/1960 | Lewis | 273/155 |
| 4,445,691 | 5/1984 | Stark et al. | 273/155 |
| 4,949,969 | 8/1990 | Johnson | 273/153 S |
| 5,074,561 | 12/1991 | Johnson | 273/153 S |
| 5,083,788 | 1/1992 | Conotter | 273/153 S |
| 5,116,053 | 5/1992 | Blankenburg et al. | 273/153 S |

FOREIGN PATENT DOCUMENTS

| | | | |
|---|---|---|---|
| 2223180 | 4/1990 | United Kingdom | 273/153 S |

*Primary Examiner*—Vincent Millin
*Assistant Examiner*—Steven B. Wong
*Attorney, Agent, or Firm*—William E. Pelton

[57] ABSTRACT

A cup/puzzle combination includes a cup including a cylindrical wall with a lower edge, a flange projecting radially from the cylindrical wall thereof, a ridge projecting downwardly from the flange. Two jambs each include a groove defined in a first side edge and a ridge formed on a second side edge. The jambs are attached to the cylindrical wall of the cup. A plurality of slides each include a first groove defined in an upper edge, a first ridge formed on a lower edge, a second groove defined in a first side edge and a second ridge formed on a second edge. A ring includes a groove defined in an upper surface. The ring is attached to the cup. The first ridge formed on a slide is slidably engageable in the first groove defined in another slide. The second ridge formed on a slide is slidably engageable in the second groove defined in another slide. The ridge formed on the flange formed on the cylindrical wall of the cup is slidably engageable in the first grooves defined in the slides. The second ridges formed on the slides are slidably engageable in the grooves defined in the jambs. The ridge formed on the jambs are slidably engageable in the second grooves defined in the slides. The first ridges formed on the slides are slidably engageable in the groove defined in the ring.

5 Claims, 4 Drawing Sheets

COMBINATION OF CUP/PUZZLE

BACKGROUND OF THE INVENTION

This invention relates to a cup and a puzzle and, particularly, to a cup/puzzle combination.

Puzzles are used for providing amusement. Such a puzzle includes a frame and a plurality of slides slidably received in the frame. The frame is of a square form and each of the slides is of a square form. A space equal in size to each of the slides remains in the frame so that the slides can be moved within the frame. Each of the slides is printed with a unique numeral or pattern. The slides make a series of numerals or a picture. The slides can be moved within the frame so as to obtain the picture. This invention is intended to combine a puzzle with a cup.

SUMMARY OF THE INVENTION

It is the primary objective of this invention to provide a cup/puzzle combination including a cup including a cylindrical wall with a lower edge, a flange projecting radially from the cylindrical wall thereof, a ridge projecting downwardly from the flange. Two jambs each include a groove defined in a first side edge and a ridge formed on a second side edge. The jambs are attached to the cylindrical wall of the cup. A plurality of slides each include a first groove defined in an upper edge, a first ridge formed on a lower edge, a second groove defined in a first side edge and a second ridge formed on a second edge. A ring includes a groove defined in an upper surface. The ring is attached to the cup. The first ridge formed on a slide is slidably engageable in the first groove defined in another slide. The second ridge formed on a slide is slidably engageable in the second groove defined in another slide, The ridge formed on the flange formed on the cylindrical wall of the cup is slidably engageable in the first grooves defined in the slides, The second ridges formed on the slides are slidably engageable in the grooves defined in the jambs, The ridge formed on the jambs are slidably engageable in the second grooves defined in the slides. The first ridges formed on the slides are slidably engageable in the groove defined in the ring.

DETAILED DESCRIPTION OF THE PREFERRED EMBODIMENT

Figure 1:
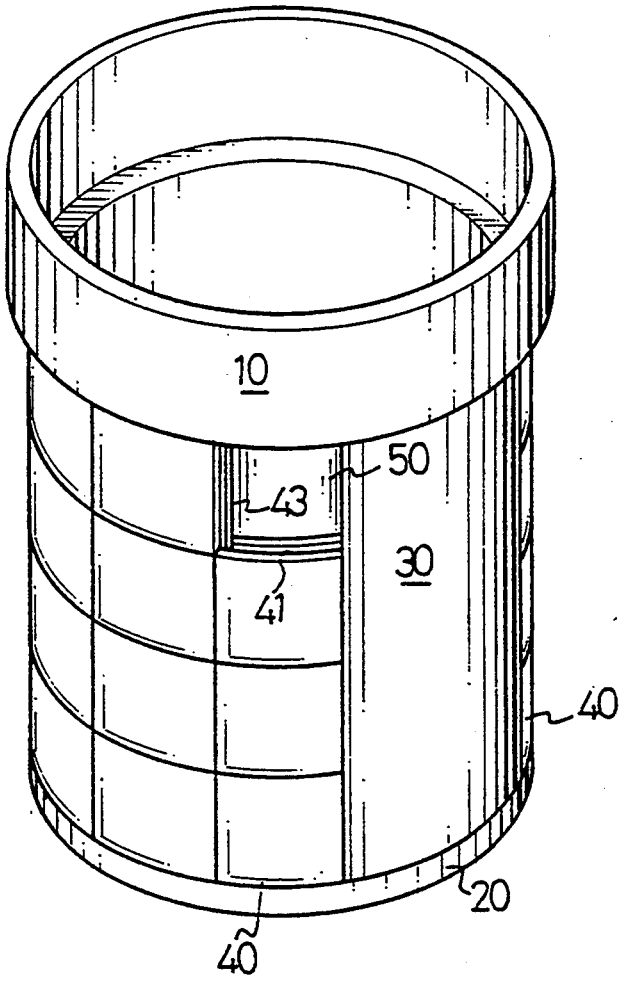
FIG. 1 is an isometric view of a first embodiment of a cup/puzzle combination in accordance with this invention.

Referring to FIG. 1, a cup/puzzle combination includes a cup 10 and two puzzles (not numbered) each including a plurality of slides 40.

Figure 2:
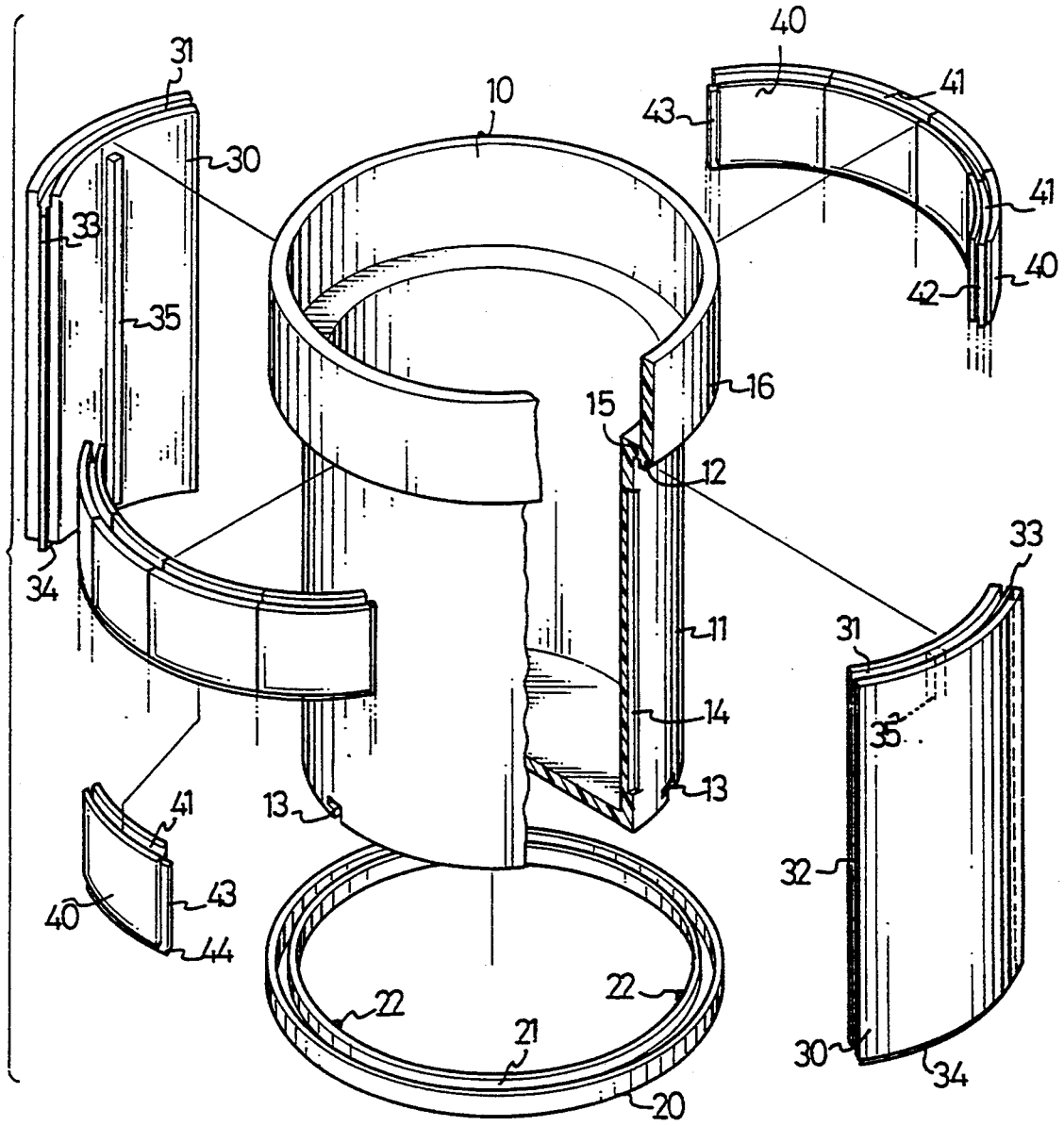
FIG. 2 is an exploded view of the first embodiment of the cup/puzzle combination according to this invention.

Referring to FIG. 2, the cup 10 includes a cylindrical wall with an upper edge and a lower edge and a bottom formed on the cup 10 near the lower edge. An annular flange 15 projects from an external surface of the cylindrical wall of the cup 10 along the upper edge of the cylindrical wall of the cup 10. An annular rim 16 projects from an upper surface of the flange 15. The annular rim 16 is useful when a user drinks liquid from the cup 10, however, the annular rim 16 is not essential. An annular ridge 12 projects from a lower surface of the annular flange 15. Two vertical grooves 14 (only one is shown) are defined in the external surface of the cylindrical wall of the cup 10. A plurality of inverted L-shaped slots 13 are defined in the lower edge of the wall of the cup 10.

There are two jambs 30 each including an upper edge, a lower edge, a first side edge and a second side edge. Each of the jambs 30 includes a groove 31 defined in the upper edge thereof, a ridge 34 formed on the lower edge thereof, a groove 32 defined in the first side edge thereof and a ridge 33 formed on the second side edge thereof. A vertical ridge 35 is formed on an internal surface of each of the jambs 30.

Each of the slides 40 includes an upper edge, a lower edge, a first side edge and a second side edge. Each of the slides 40 includes a groove 41 defined in the upper edge thereof, a ridge 44 formed on the lower edge thereof, a groove 42 defined in the first side edge thereof and a ridge 43 formed on the second side edge of each of the slides 40.

The jambs 30 and the slides 40 make a cylindrical wall, i.e., each of them is a portion of such a cylindrical wall. However, the area of each of the jambs 30 is larger than the area of each of the slides 40.

A ring 20 includes an upper surface, a lower surface, an external surface and an internal surface. A groove 21 is defined in the upper surface of the ring 20. A plurality of bosses 22 are formed on the internal surface of the ring 20.

Figure 3:
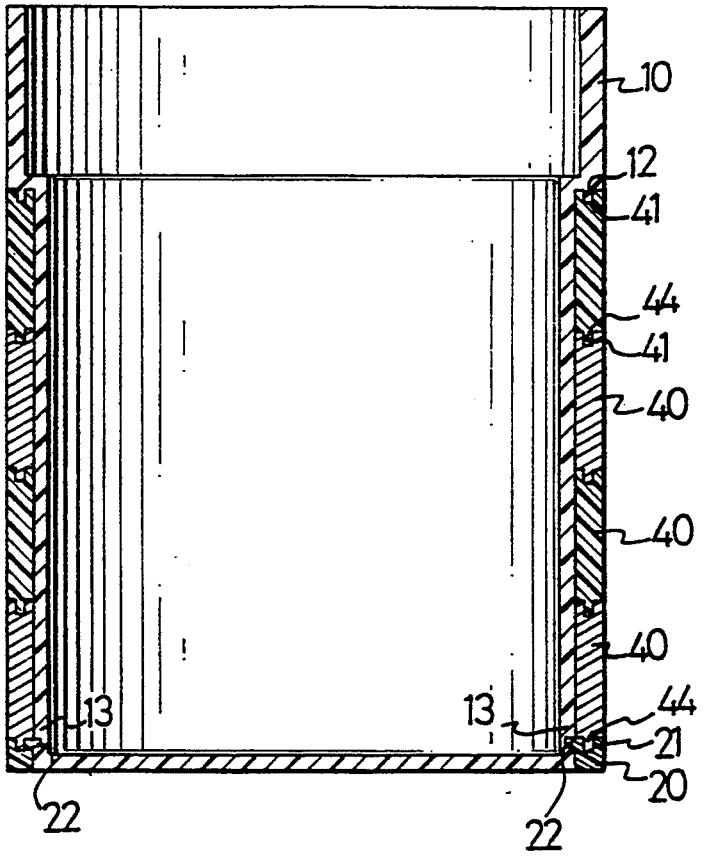
FIG. 3 is a cross-sectional view of the first embodiment of the cup/puzzle combination according to this invention.

The ridge 12 is engaged in the grooves 31 so that the jambs 30 cannot be radially moved from the cup 10. The ridges 35 are engaged in the vertical grooves 14 thus preventing the rotation of the jambs 30 in respect to the cup 10. The ridge 44 formed on a slide 40 is slidably engageable in the groove 41 defined in another slide 40 (see FIG. 3). The ridge 43 formed on a slide 40 is slidably engageable in the groove 42 defined in another slide 40. The ridge 12 is slidably engageable in the grooves 41 defined in the slides 40 (see FIG. 3) when the slides 40 are adjacent the flange 15. The ridges 33 are slidably engageable in the grooves 42 defined in the slides 40 when the slides 40 are adjacent the second edges of the jambs 30. The ridges 43 formed on the slides 40 are slidably engageable in the grooves 32 when the slides 40 are adjacent the first edges of the jambs 30. The ridges 34 formed on the jambs 30 are engageable in the groove 21. The ridges 44 formed on the slides 40 are slidably engageable in the groove 21 when the slides 40 are adjacent the ring 20. The bosses 22 are engageable in the inverted L-shaped slots 13 for retaining the ring 20, the jambs 30 and the slides 40 on the cup 10.

Referring to FIG. 1, the flange 15, the ring 12 and the jambs 30 make two frames (not numbered). Each of the frames can accommodate sixteen slides 40, however, only fifteen slides 40 are enclosed in each of the frames. That is, a space 50 equal in size to each of the slides 40 remains in each of frames so that the slides 40 are slidable.

Figure 4:
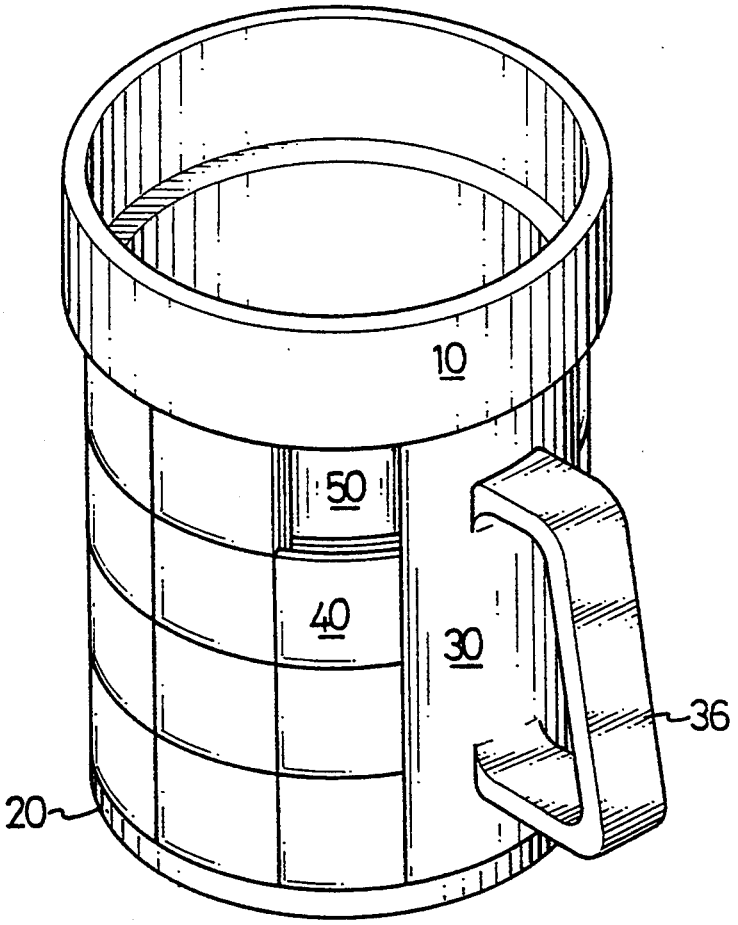
FIG. 4 is an isometric view of a second embodiment of the cup/puzzle combination according to this invention.

FIG. 4 shows a second embodiment of the cup/puzzle combination in accordance with this invention. A handle 36 is formed on the external surface of one of the jambs 30 for providing a user with convenience when using the cup to drink from.

What is claimed is:

1. A cup/puzzle combination comprising:

a cup including a cylindrical wall with a lower edge, a flange projecting radially from the cylindrical wall thereof, a ridge projecting downwardly from the flange;

two jambs each including a groove defined in a first side edge and a ridge formed on a second side edge wherein the jambs are attached to the cylindrical wall of the cup;

a plurality of slides each including a first groove defined in an upper edge, a first ridge formed on a lower edge, a second groove defined in a first side edge and a second ridge formed on a second edge;

a ring including a groove defined in an upper surface wherein the ring is attached to the cup;

wherein the first ridge formed on a slide is slidably engageable in the first groove defined in another slide, and the second ridge formed on a slide is slidably engageable in the second groove defined in another slide, and the ridge formed on the flange formed on the cylindrical wall of the cup is slidably engageable in the first grooves defined in the slides, and the second ridges formed on the slides are slidably engageable in the grooves defined in the jambs, and the ridges formed on the jambs are slidably engageable in the second grooves defined in the slides, and the first ridges formed on the slides are slidably engageable in the groove defined in the ring.

2. A cup/puzzle combination in accordance with claim 1 wherein each of the jambs includes a horizontal groove defined in an upper edge and a horizontal ridge formed on a lower edge, and the ridge formed on the flange formed on the cylindrical wall of the cup is engageable in the horizontal groove defined therein, and the horizontal ridge formed thereon is engageable in the groove defined in the ring, so that the jambs cannot be radially moved from the cup.

3. A cup/puzzle combination in accordance with claim 1 wherein the cylindrical wall of the cup defines two vertical grooves and each of the jambs includes a vertical ridge formed thereon so that the vertical ridge formed on each of the jambs is engageable in each of the vertical grooves defined in the cylindrical wall of the cup for preventing rotation of the jambs relative to the cup.

4. A cup/puzzle combination in accordance with claim 1 wherein the cylindrical wall of the cup includes a plurality of inverted L-shaped slots defined in a lower edge and the ring includes a corresponding number of bosses projecting radially inwardly therefrom, and the bosses formed on the ring are engageable in the inverted L-shaped slots defined in the cylindrical wall of the cup.

5. A cup/puzzle combination in accordance with claim 1 wherein one of the jambs includes a handle formed thereon.

* * * * *